US011268033B2

(12) United States Patent
Long et al.

(10) Patent No.: US 11,268,033 B2
(45) Date of Patent: Mar. 8, 2022

(54) MANAGING ORE BLENDING FOR FROTH SOLIDS CONTROL

(71) Applicant: SYNCRUDE CANADA LTD. in trust for the owners of the Syncrude Project as such owners exist now and in the future, Fort McMurray (CA)

(72) Inventors: Jun Long, Edmonton (CA); Shane Hoskins, Edmonton (CA); Kevin Reid, Edmonton (CA)

(73) Assignee: SYNCRUDE CANADA LTD. in trust for the owners of, Fort McMurray (CA)

( * ) Notice: Subject to any disclaimer, the term of this patent is extended or adjusted under 35 U.S.C. 154(b) by 144 days.

(21) Appl. No.: 16/588,675

(22) Filed: Sep. 30, 2019

(65) Prior Publication Data

US 2020/0102505 A1 Apr. 2, 2020

Related U.S. Application Data

(60) Provisional application No. 62/739,732, filed on Oct. 1, 2018.

(51) Int. Cl.

| | |
|---|---|
| ***C10G 1/00*** | (2006.01) |
| ***C10G 1/04*** | (2006.01) |
| ***C10G 33/04*** | (2006.01) |

(52) U.S. Cl.

CPC ..... *C10G 1/047* (2013.01); *C10G 1/045* (2013.01); *C10G 33/04* (2013.01); *C10G 2300/208* (2013.01); *C10G 2300/4081* (2013.01)

(58) Field of Classification Search

CPC ..... C10G 1/047; C10G 1/045; C10G 33/04; C10G 2300/4081; C10G 2300/208

See application file for complete search history.

(56) References Cited

U.S. PATENT DOCUMENTS

| | | | | |
|---|---|---|---|---|
| 5,039,227 | A | 8/1991 | Leung et al. | |
| 2013/0256196 | A1* | 10/2013 | Spence | C10G 1/047 208/391 |

OTHER PUBLICATIONS

Romanova et al. "Investigation of Oil Sands Froth Treatment" Canadian Journal of Chemical Engineering, Oil Sands Special Issue, vol. 82, No. 4, pp. 710-721, Aug. 2004.

* cited by examiner

*Primary Examiner* — Prem C Singh
*Assistant Examiner* — Brandi M Doyle
(74) *Attorney, Agent, or Firm* — Bennett Jones LLP

(57) ABSTRACT

A method for controlling the solids distribution in a bitumen froth produced when processing an oil sands ore having a $d_{50}$ of about 250 μm or greater and a $d_{90}$ of about 450 μm or greater is provided comprising adding a high-fines material having a $d_{50}$ of about 50 μm or less and a fines content of about 40% of the solids or greater to the oil sands ore to form an ore blend; and processing the ore blend in a water-based bitumen extraction process to produce the bitumen froth.

11 Claims, 7 Drawing Sheets

MANAGING ORE BLENDING FOR FROTH SOLIDS CONTROL

FIELD OF THE INVENTION

The present invention relates to a method for managing oil sands ore blending to reduce the amount of coarse and very coarse solids in a bitumen froth product. In particular, materials comprising high-fines content are blended with oil sands ore having a high content of very coarse solids prior to bitumen extraction.

BACKGROUND OF THE INVENTION

Oil sands ore is a mixture of bitumen, minerals including clays and sands, and water. Recovering bitumen from the ore begins with excavating the ore, such as by using a shovel in an open pit mine. Trucks deliver the excavated ore to a hopper, which in turn feeds the ore to a crusher. The crushed ore is mixed with hot or warm water to form a slurry. A pipeline hydro-transports the slurry to an extraction facility where it is subjected to gravity separation in a primary separation vessel (PSV) to produce a bitumen froth process stream, a middlings stream, and a tailings stream. The bitumen froth is then transported, often through a froth pipeline, to a froth treatment plant, where the froth is further treated with light hydrocarbon solvent and subjected to mechanical separation processes to recover bitumen.

In some mine areas, the ore body contains mainly good quality ores. Some of these good quality ores contain a high amount of coarse solids that are greater than 250 μm, resulting in a $d_{50}$ of 250 μm (i.e., 50% of the particles are larger than 250 μm) or higher and $d_{90}$ of 450 μm (i.e., 10% of the particles are larger 450 μm) or higher. When these ores having a high amount of coarse solids are processed in a water-based bitumen extraction process, the performance in terms of bitumen recovery is often very good. However, the froth produced may contain a high amount of coarse solids, especially a high amount of very coarse solids. In cases where the extraction facilities are far away from the froth treatment plant, a froth pipeline that runs tens of kilometers has to be used to transport the froth from extraction to froth treatment.

Currently, froth pipelines are designed to transport froth that normally has a high fines content (where 60% or more of the solids are <44 μm) and a low very coarse solids content (where $d_{50}$ is low at about 35 μm). However, if the froth contains a considerable amount of coarse particles, it is difficult to transport the froth due to the settling of the coarse particles in the pipeline. Further, there is a required amount of fines to be present in the froth to ensure that the froth viscosity is high enough such that the coarse particulars can be carried through the pipeline. In the art, the impact of coarse and fines solids is quantified in models by assuming the fines and water components constitute a carrier fluid and the >44 micron particles are transported within this carrier fluid; the $d_{50}$ of the >44 micron fraction of the solids is called the coarse $d_{50}$, Thus, the solids content in the froth must be managed in order to transport the froth from a remote extraction facility to a froth treatment plant.

Currently, there is no measure available to specifically control the coarse solids content in the produced froth when processing good ores with a high amount of coarse particles. To reduce froth solids content, an underwash water stream is currently used in the primary separation vessel (PSV) to form a water layer between the froth and middlings. Chemical aids such as caustic are also used in extraction and these aids are mainly for improving the overall extraction performance (e.g., bitumen recovery). However, it has been shown by the present applicant that using underwash and/or aids in the current ways does not significantly reduce the coarse particles content in the froth.

Ore blending is currently used to mix ores of different qualities from different locations to form a feed that meets the requirements for extraction. These requirements often include: (1) the feed grade must be ≥10.5%, (2) the feed fines must be ≥28%<44 μm. However, these requirements do not take the transportability of the produced froth into account when the froth needs to be pumped from the remote extraction site to the froth treatment plant. There is no requirement to have a minimum fines content in the feed.

Accordingly, there is a need in the art for a method for reducing the amount of coarse solids and increasing the amount of fine solids in a bitumen froth product when processing good quality ores containing a high amount of coarse solids.

SUMMARY OF THE INVENTION

In one aspect, the present invention provides a method for controlling the solids distribution in a bitumen froth produced when processing an oil sand ore having a $d_{50}$ of about 250 μm or greater and a $d_{90}$ of about 450 μm or greater, the method comprising the steps of:

adding a high-fines material having a $d_{50}$ of about 50 μm or less and a fines content of about 40% of the solids or greater to the oil sand ore to form an ore blend; and processing the ore blend in a water-based bitumen extraction process to produce the bitumen froth.

It was discovered that the high-fines material should be added to the oil sand ore prior to processing rather than at a later stage of extraction so that the feed ore blend has an increased fines content and a reduced coarse solids content. In one embodiment, the bitumen froth has a $d_{50}$ of less than 35 μm (coarse $d_{50}$ less than 145 microns). In one embodiment, between about 5 wt % and about 30 wt % of the high-fines material is added to the oil sands ore. In one embodiment, the high-fines material has a fines content of 50% of the solids or greater. In one embodiment, the high-fines material has a fines content of 60% of the solids or greater. In one embodiment, the high-fines material has a fines content of 70% of the solids or greater. In one embodiment, the high-fines material has a fines content of 80% of the solids or greater.

BRIEF DESCRIPTION OF THE DRAWINGS

In the drawings shown in the specification, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF PREFERRED EMBODIMENT

Definitions. Any term or expression not expressly defined herein shall have its commonly accepted definition understood by a person skilled in the art. As used herein, the following terms have the following meanings.

As used herein, "oil sands ore" refers to a mixture of bitumen, minerals, and water prior to being subjected to a bitumen extraction process.

As used herein, "grade" refers to the bituminous and fines content of an oil sands ore.

As used herein, "fines" refers to the component an oil sands ore having a particle size less than 44 microns. As used herein, "coarse $d_{50}$" refers to the median particle size of the greater than 44 microns portion of a solids distribution.

As used herein, "coarse solids" refers to the component of an oil sands ore having a particle size greater than about 180 microns.

As used herein, "very coarse solids" refers to the component of an oil sands ore having a particle size greater than about 500 microns.

As used herein, "percentile particle size" refers to the particle diameter corresponding to a percentile rank in a cumulative particle size distribution of particles in an oil sands ore. For example, $d_{50}$, refers to the particle diameter corresponding to a $50^{th}$ percentile rank in a cumulative particle size distribution of particles in an oil sands ore.

As used herein, a "water-based bitumen extraction process" comprises three main steps: oil sands slurry preparation, slurry conditioning and bitumen separation in primary separation vessels (PSVs) and is performed at a water-based bitumen extraction plant.

As used herein, "froth treatment" refers to treating bitumen froth with light hydrocarbon solvent and subjecting the diluted froth ("dilfroth") to mechanical separation processes to recover diluted bitumen ("dilbit") for further upgrading.

As used herein, a "high-fines material" is a material comprised of solids having a $d_{50}$ of about 50 μm or less and a fines content of about 40% of the solids or greater.

As used herein, "waste material" means a high-fines material generally available from an oil sand mine site including, but are not limited to, overburden, interburden, pond mud, below cut-off grade ore, meaning oil sand ore having a grade of 6 wt % bitumen or less) and oil sand tailings such as Fluid Fine Tailings (FFT) from tailings ponds and the like.

As used herein, "Fluid Fine Tailings" ("FFT") means a liquid suspension of oil sands fines in water with a solids content greater than 2% but less than the solids content corresponding to the Liquid Limit. As used herein, "Liquid Limit" means the geotechnical water content defining the boundary between a liquid and a solid in soil mechanics, with equivalent remolded shear strength of 1 to 2 kPa. As used herein, "Mature Fine Tailings" ("MFT") are FFT with a low sand to fines ratio (<0.3) and a solids content greater than 30% (nominal).

Figure 1:
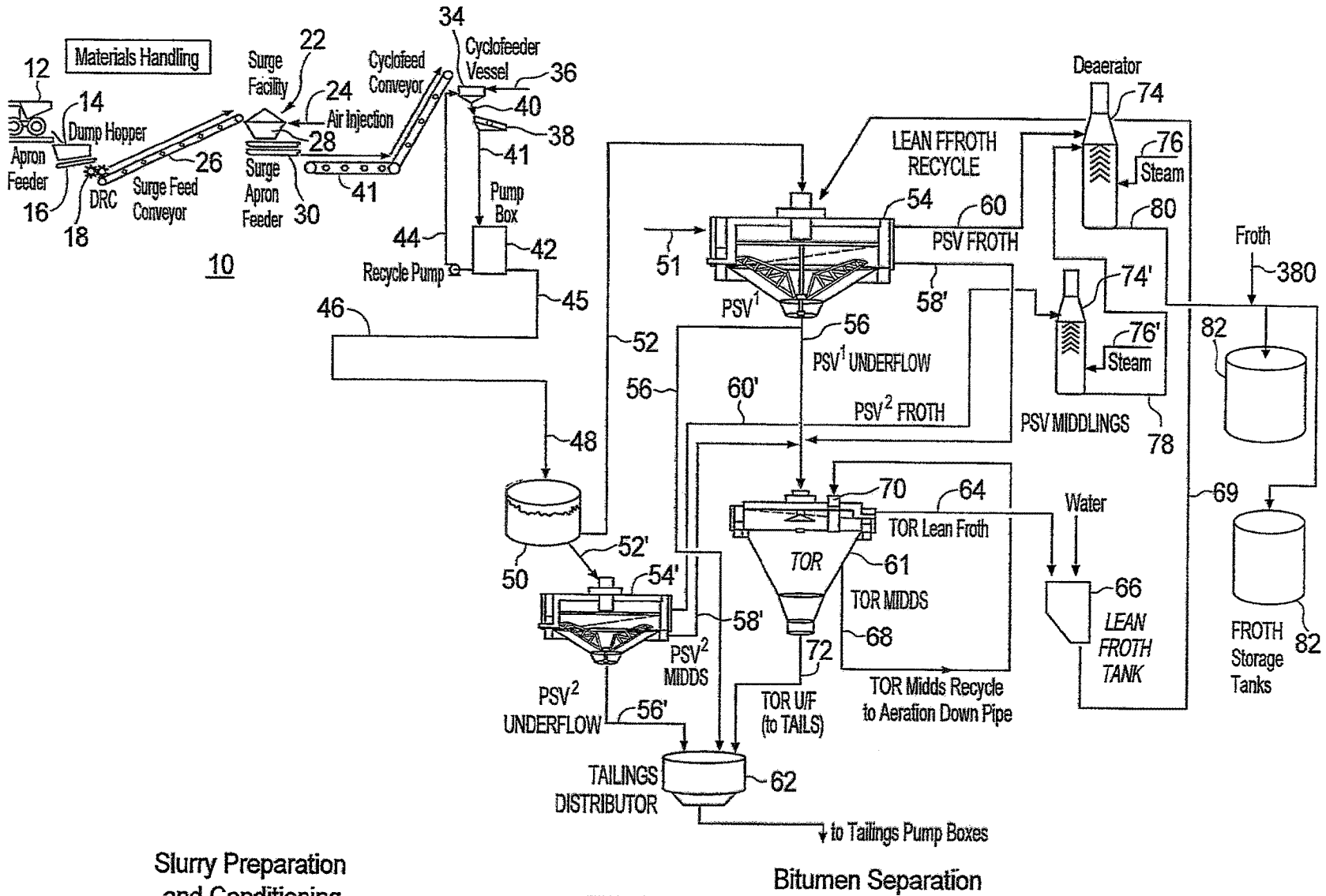
FIG. 1 shows a water-based bitumen extraction process and process line useful in the present invention.

FIG. 1 is a schematic of a typical water-based bitumen extraction plant and process. A water-based bitumen extraction plant generally comprises an oil sands slurry preparation plant, a slurry conditioning apparatus and a bitumen separation plant. In this particular embodiment, oil sands slurry preparation plant 10 comprises mined oil sands being delivered by trucks 12 to a hopper 14 having an apron feeder 16 there below for feeding mined oil sands to a double roll crusher 18 to produce pre-crushed oil sands. Surge feed conveyor 26 delivers pre-crushed oil sands to surge facility 22 comprising surge bin 28 and surge apron feeders 30 there below. Air 24 is injected into surge bin 28 to prevent the oil sands from plugging.

The surge apron feeders 30 feed the pre-crushed oil sands to cyclofeeder conveyer 41, which, in turn, delivers the oil sands to cyclofeeder vessel 34 where the oil sands and water 36 are mixed to form oil sands slurry 40. Oil sands slurry 40 is then screened in screen 38 and screened oil sands slurry 41 is transferred to pump box 42. The cyclofeeder system is described in U.S. Pat. No. 5,039,227. Optionally, oversize lumps from screens 38 are sent to secondary reprocessing (not shown). Oil sands slurry 45 is then conditioned by pumping the slurry through a hydrotransport pipeline 46, from which conditioned oil sands slurry 48 is delivered to slurry distribution vessel 50. A portion of oil sands slurry 44 can be recycled back to cyclofeeder 34.

The bitumen separation plant comprises at least one primary separation vessel, or "PSV". A PSV is generally a large, conical-bottomed, cylindrical vessel. In the embodiment shown in FIG. 1, slurry is distributed by the slurry distribution vessel 50 (also referred to as "superpot") to two PSVs 54, 54' via slurry streams 52, 52'. PSV 54' is a smaller version of PSV 54, having 0.4 times the volume of the full sized PSV 54. The slurry streams 52, 52' are commonly diluted with flood water to an appropriate density prior to being fed to the PSVs. Generally, a slurry density of about 1.35 to 1.45 SG is desired. The slurry 52, 52' is retained in the PSV 54, 54' under quiescent conditions for a prescribed retention period. During this period, the aerated bitumen rises and forms a froth layer, which overflows the top lip of the vessel and is conveyed away in a launder to produce bitumen froth 60, 60'. The sand grains sink and are concentrated in the conical bottom and leave the bottom of the vessel as a wet tailings stream 56, 56'. Middlings 58, 58', a mixture containing fine solids and bitumen, extend between the froth and sand layers.

Some or all of tailings stream 56 and middlings 58, 58' are withdrawn, combined and sent to a secondary flotation process carried out in a deep cone vessel 61 wherein air is sparged into the vessel to assist with flotation of remaining bitumen. This vessel is commonly referred to as a tailings oil recovery vessel, or TOR vessel. The lean bitumen froth 64 recovered from the TOR vessel 61 is stored in a lean froth tank 66 and the lean bitumen froth 64 may be recycled to the PSV feed. The TOR middlings 68 may be recycled to the TOR vessel 61 through at least one aeration down pipe 70. TOR undertow 72 is deposited into tailings distributor 62, together with tailings streams 56, 56' from PSVs 54 and 54', respectively. It is understood that a bitumen separation process can be comprised of one or multiple primary separation vessels.

PSV 54 bitumen froth 60 is then deaerated in steam deaerator 74 where steam 76 is added to remove air present in the bitumen froth. Similarly, PSV 54' bitumen froth 60' is deaerated in steam deaerator 74' where steam 76' is added. Deaerated bitumen froth 78 from steam deaerator 74' is added to steam deaerator 74 and a final deaerated bitumen froth product 80 is stored in at least one froth storage tank 82 for further treatment. A typical deaerated bitumen froth comprises about 60 wt % bitumen, 30 wt % water and 10 wt % solids.

Depending upon the location of the bitumen extraction plant, the deaerated bitumen froth may be pumped through a froth pipeline to a froth treatment plant, which may be tens of kilometers away from the bitumen extraction plant. When the deaerated froth contains a considerable amount of coarse/very coarse particles, it is difficult to transport the froth due to the settling of the coarse/very coarse particles. Thus, the solids content, especially the fines and coarse/very coarse solids content in the froth, must be managed in order to transport the froth from the remote extraction site to the froth treatment facilities.

Figure 2:
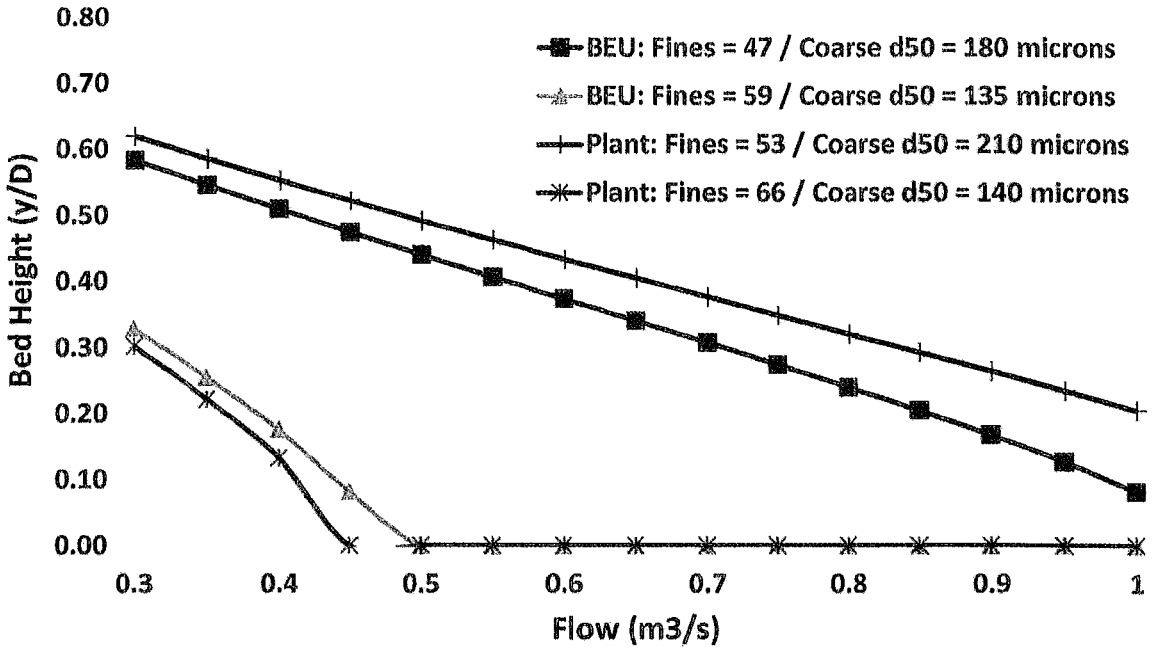
FIG. 2 is a graph showing the stationary bed height (y/D) for various particle sizes with a typical bitumen froth composition.

FIG. 2 plots the bed height (vertical position in a pipe determined by a densitometer), as a fraction of the pipe diameter (y/D), of a particle bed forming at the bottom of a pipeline at various flow rates ($m^3/s$) for a froth line composition (55° C./28% water) having increasingly larger solids present therein. As mentioned, a typical froth having a coarse $d_{50}$ particle size of 140 microns and fines content of 66 wt % requires a minimum flow rate of 0.440 $m^3/s$ in order to avoid formation of a bed at the bottom of the pipe. However, as previously discussed, more and more of the ore bodies at the applicant's mine site contain ores having greater amounts of coarse solids (i.e., greater than 180-200 microns). FIG. 2 clearly shows that, as the coarse $d_{50}$ in the froth increases (and the fines content decreases), at the same flow rate of 0.440 $m^3/s$, there is an increasingly larger bed being formed. In particular, at a coarse $d_{50}$ of 180 microns or greater and fines content of approximately 50 wt %, even a flow rate of 1 $m^3/s$ cannot prevent the formation of a bed in the pipeline.

The present applicant has discovered that the above problem occurs primarily when the oil sands ore feed to the extraction plant contains mainly good quality ores processing ore with high amounts of coarse/very coarse solids. Studies show that there is a correlation/relationship between the particle size distributions (PSDs) of the solids in the ore and in the corresponding froth, indicating that the amount and types of solids in the froth are related to or determined by the solids in the ore. When processing good ores with high coarse solids, the produced froth contains a considerable amount of coarse particles (and low fines content), in particular, very coarse solids, thus causing problems in froth transportation. Hence, it is desirable to reduce the coarse solids content in the froth to make the froth transportable in the froth pipeline.

One viable way to reduce the coarse particles content in the froth is to create ore feed blends which still have an acceptable fines content (e.g., ~25%) but also have a relatively low $d_{50}$ value (<300 μm). One approach for achieving this is to change the mine plan such that ores containing relatively high fines are available for ore blending. However, this approach can be very costly due to the needs to alter the mine plan. In some cases, this approach may not even work if the ore body does not contains enough high-fines ores.

An alternative approach to creating ore feeds with desired fines content and solids $d_{50}$ value is to add waste materials having very high fines/clays contents to good quality ores having high amounts of coarse solids. Useful waste materials can include, but are not limited to, overburden, interburden, pond mud. Clearwater formations (also known as KC clays), and below cut-off grade ore (e.g., ore having a grade of less than 6% bitumen), which materials are always available in any ore body. Other high-fines wastes available in an oil sand processing facility, such as Fluid Fine Tailings (FFT) from the tailings ponds, can also be used for this purpose. Thus, by blending a certain percentage of these waste materials with the ore feed, the feed fines content can be increased to the desired level and the feed $d_{50}$ value can be reduced accordingly. It has been shown by the present applicant that adding a waste material to a good ore to "dilute" the good ore is able to significantly increase the fines content and to significantly reduce its solids $d_{50}$ and $d_{90}$ values of the froth produced from the good ore, thus making the resultant froth transportable in a froth pipeline.

Thus, adding waste materials to the ore feeds does not require a change to the mine plan and thus can avoid the cost associated with changing the mine plan. In addition, it can avoid or reduce the normal costs associated for the removal of the waste materials in the ore body. This is because these waste materials with a high fines/clay content are normally detrimental to the extraction process when they are blended in the ore feed, and, as a result, they need to be removed from the ores in normal operation. It is very costly to remove them completely because these materials are normally embedded with ores and requires the use of small equipment and a significant amount of labor to remove them.

EXAMPLE 1

One major concern is that the addition of waste materials having a high fines content to an oil sands ore feed might have a negative impact or "poisoning effect" on bitumen extraction performance. In order to determine any such detrimental effects, a number of different waste materials were added to a good quality ore having low fines content but high coarse solids content to produce a blended oil sands ore and the bitumen froth was extracted from the blended ore using a Batch Extraction Unit (BEU). The BEU is a low-shear laboratory approximation of the Clark Hot Water Extraction Process. It typically produces a froth similar to that obtained from the traditional commercial process with conditioning and separation stages. Froth is produced in two stages with the BEU: a "primary froth" and a "secondary froth." A detailed description of the steps and variables involved in the BEU extraction can be found at Romanova, U. G., Yarranton, H. W., Schramm, L. L., and Shelfantook, W. E., *Investigation of Oil Sands Froth Treatment*; Canadian Journal of Chemical Engineering, Oil Sands Special Issue, Vol. 82, No. 4, pp. 710-721, August 2004. A summary of the BEU test conditions are shown in Table 1 below.

TABLE 1

| Summary of BEU Test Conditions | |
|---|---|
| Conditioning Temperature, ° C. | 45 |
| Flooded Slurry Temperature, ° C. | 35 |
| Water Type | Oil sand process water |
| Caustic (NaOH), wt % of oil sand | 0.01 |

Figure 3:
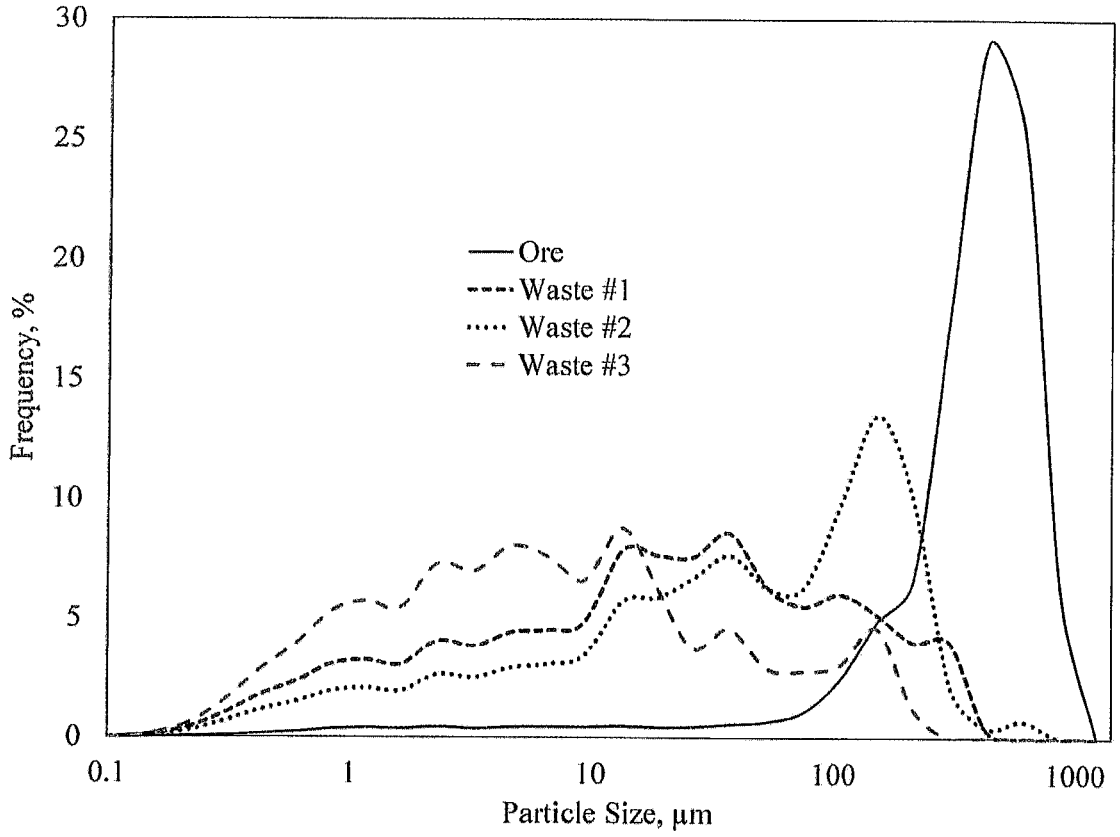
FIG. 3 is a graph showing the solids particle size distribution of an oil sands ore having a higher than average amount of coarse solids and three Waste Materials (#1, #2 and #3) useful in the present invention.

The compositions of the oil sands ore and the three waste materials tested are shown in Table 2 below. As can be seen in Table 2, the oil sand ore tested was good grade ore, i.e., high bitumen (11.1 wt %) and low fines (i.e., 4.8%). However, the solids were primarily coarse solids (85.1%>180 μm), with 31.7% of the solids being very coarse solids (>500 μm). Wastes #1 and #2 are materials from an ore body. They still contained bitumen. As their bitumen contents were below the cut-off grade (e.g., less than 6 wt %), these materials were considered as wastes. Waste #3 was FFT from a tailings pond, which had the highest amount of fines content, i.e., 85.4% of the solids were less than 44 microns. The particle size distributions for the oil sand ore and Waste Materials #1, #2 and #3 are shown in FIG. 3.

TABLE 2

Information for the Ore and Water Materials Tested

| Material | Composition (wt %) | | | Fines | Coarse | very coarse | $d_{50}$ | $d_{90}$ |
|---|---|---|---|---|---|---|---|---|
| Type | Bitumen | Water | Solids | % <44 μm | % >180 μm | % >500 μm | μm | μm |
| Ore | 11.1 | 1.2 | 87.7 | 5.8 | 85.1 | 31.7 | 409.0 | 671.1 |
| Waste #1 | 4.4 | 10.8 | 84.8 | 68.6 | 8.4 | 0.0 | 19.8 | 157.3 |
| Waste #2 | 6.0 | 8.1 | 85.9 | 50.7 | 13.4 | 0.7 | 42.6 | 197.5 |
| Waste #3 | 2.5 | 64.2 | 33.3 | 85.4 | 1.2 | 0.0 | 6.0 | 76.8 |

Table 3 below shows the primary bitumen recovery (%), primary froth composition, and primary froth solids when 5, 10, 15, 20 and 30 wt % of each of Waste #1, Waste #2 and Waste #3 were added to the oil sands ore as compared to no waste material addition. As can be seen in Table 3, without any waste material addition, the oil sands ore's primary bitumen recovery was 90.3%. However, the primary bitumen froth had a $d_{50}$ of 49 μm and a $d_{90}$ of 352.3 μm. In addition, 24% of the solids in the primary bitumen froth were greater than 180 μm.

TABLE 3

Summary of BEU Test Results

| Waste | | Primary Recovery | Primary Froth Composition | | | Primary Froth Solids | | | | | | Coarse d50 |
|---|---|---|---|---|---|---|---|---|---|---|---|---|
| Type | wt % | (%) | Bitumen | Water | Solids | % <44 μm | $d_{50}$, μm | $d_{90}$, μm | % >180 μm | % >360 μm | % >500 μm | μm |
| | 0 | 90.3 | 53.7 | 33.8 | 12.5 | 48.9 | 49 | 342.3 | 24 | 9 | 2.8 | 180 |
| Waste #1 | 5 | 88.8 | 48.3 | 41.1 | 10.6 | 66.6 | 21.5 | 165.6 | 8.9 | 2.5 | 0.6 | 110 |
| Waste #1 | 10 | 83.6 | 44.8 | 42.7 | 12.5 | 69.8 | 20.3 | 148.5 | 7.5 | 2.3 | 0.6 | 110 |
| Waste #1 | 15 | 87.2 | 47.1 | 39.8 | 13.1 | 72.4 | 20 | 127.4 | 5.6 | 1.7 | 0.5 | 100 |
| Waste #1 | 20 | 87.9 | 45.2 | 40.6 | 14.2 | 73.7 | 19.9 | 118.9 | 5 | 1.5 | 0.5 | 100 |
| Waste #1 | 30 | 85.4 | 45 | 40.5 | 14.5 | 72.8 | 21.1 | 121.7 | 4.9 | 1.2 | 0.5 | 95 |
| Waste #2 | 5 | 89 | 47.5 | 42.1 | 10.4 | 59.4 | 27.9 | 268.2 | 15.1 | 5.9 | 2 | 135 |
| Waste #2 | 10 | 89.5 | 45.6 | 42 | 12.4 | 63.6 | 24.9 | 178.2 | 9.9 | 3.5 | 1.4 | 115 |
| Waste #2 | 15 | 87.7 | 47.7 | 38.9 | 13.4 | 65 | 25 | 155.6 | 7.8 | 2.4 | 0.7 | 110 |
| Waste #2 | 20 | 88.9 | 51 | 34.5 | 14.5 | 66.3 | 24.7 | 144.1 | 6.6 | 1.8 | 0.6 | 100 |
| Waste #2 | 30 | 88.8 | 45.7 | 38.6 | 15.7 | 65.9 | 25.8 | 142.7 | 6.1 | 1.7 | 0.4 | 100 |
| Waste #3 | 5 | 90.1 | 47.4 | 42.5 | 10.1 | 60.8 | 23.1 | 202.2 | 12.3 | 4.3 | 1.4 | 130 |
| Waste #3 | 10 | 89.1 | 53 | 36.3 | 10.8 | 67.9 | 16.5 | 159.2 | 7.7 | 0.1 | 0 | 120 |
| Waste #3 | 15 | 91.8 | 43.8 | 44.3 | 11.9 | 69 | 15.5 | 149.9 | 6.3 | 0 | 0 | 120 |
| Waste #3 | 20 | 90.1 | 41.7 | 46.5 | 11.8 | 75.4 | 12.5 | 122.3 | 2.7 | 0 | 0 | 105 |
| Waste #3 | 30 | 89.5 | 43.1 | 38.2 | 18.6 | 67.3 | 15.1 | 196.6 | 11.8 | 0.3 | 0 | 145 |

Figure 4:
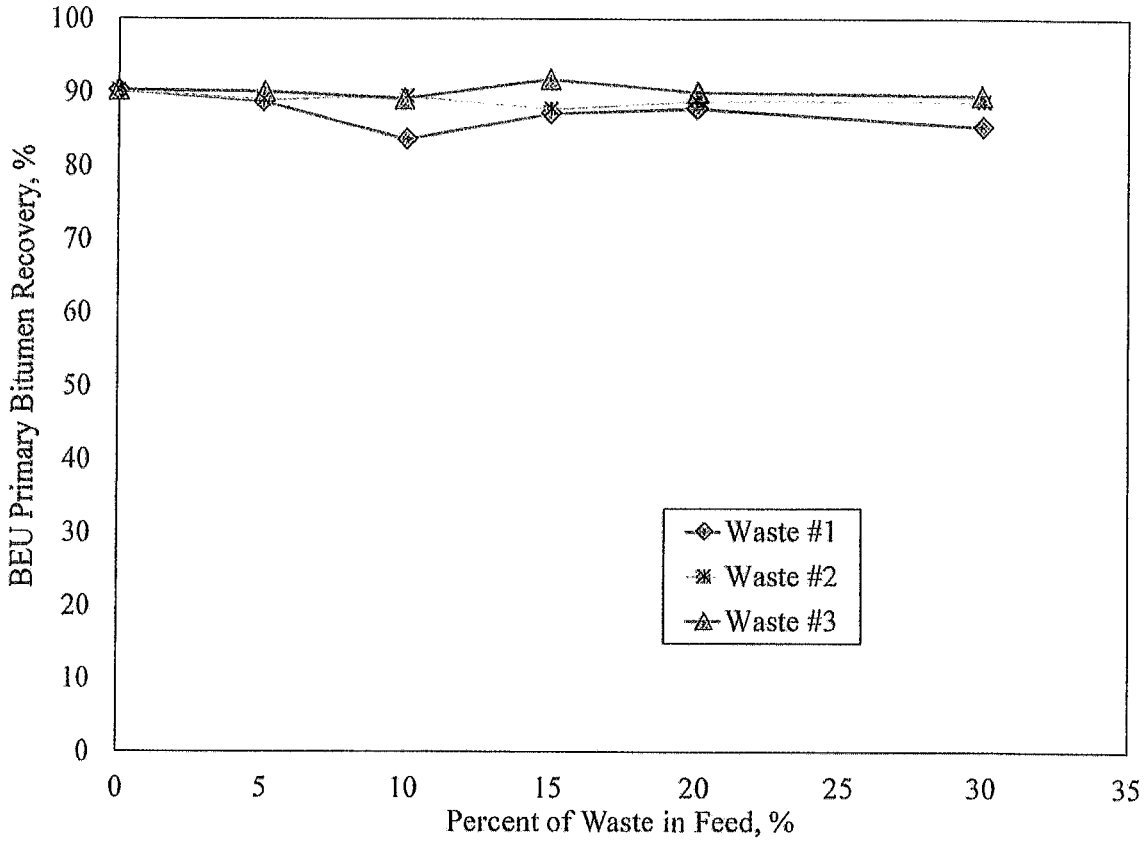
FIG. 4 is a graph showing the BEU primary bitumen recovery (%) when the oil sands ore shown in FIG. 2 was diluted with Waste Materials #1, #2, and #3.

As can be seen from Table 3, the addition of waste material did not have a significantly negative affect on the primary bitumen recovery. Of the waste materials tested, Waste #3 in particular appeared to have little or no effect on primary bitumen recovery, even at the highest concentration of 30 wt %. FIG. 4 is a graph of the BEU primary bitumen recovery as a function of waste dilution for all three waste materials tested.

Even more importantly, Table 3 shows that high amounts (e.g., 30 wt %) of waste material were not always required to significantly reduce the coarse solids content in the primary bitumen froth. For example, with Waste #1, a significant reduction in the % solids greater than 180 μm (with a consequent increase in fines content and reduction in coarse $d_{50}$) was seen even at the very lowest amount (i.e., 5 wt %) of waste addition. However, in general, between 15 wt % and 30 wt % for each waste material brought about the most significant reduction in in both $d_{50}$ and $d_{50}$.

Figure 5:
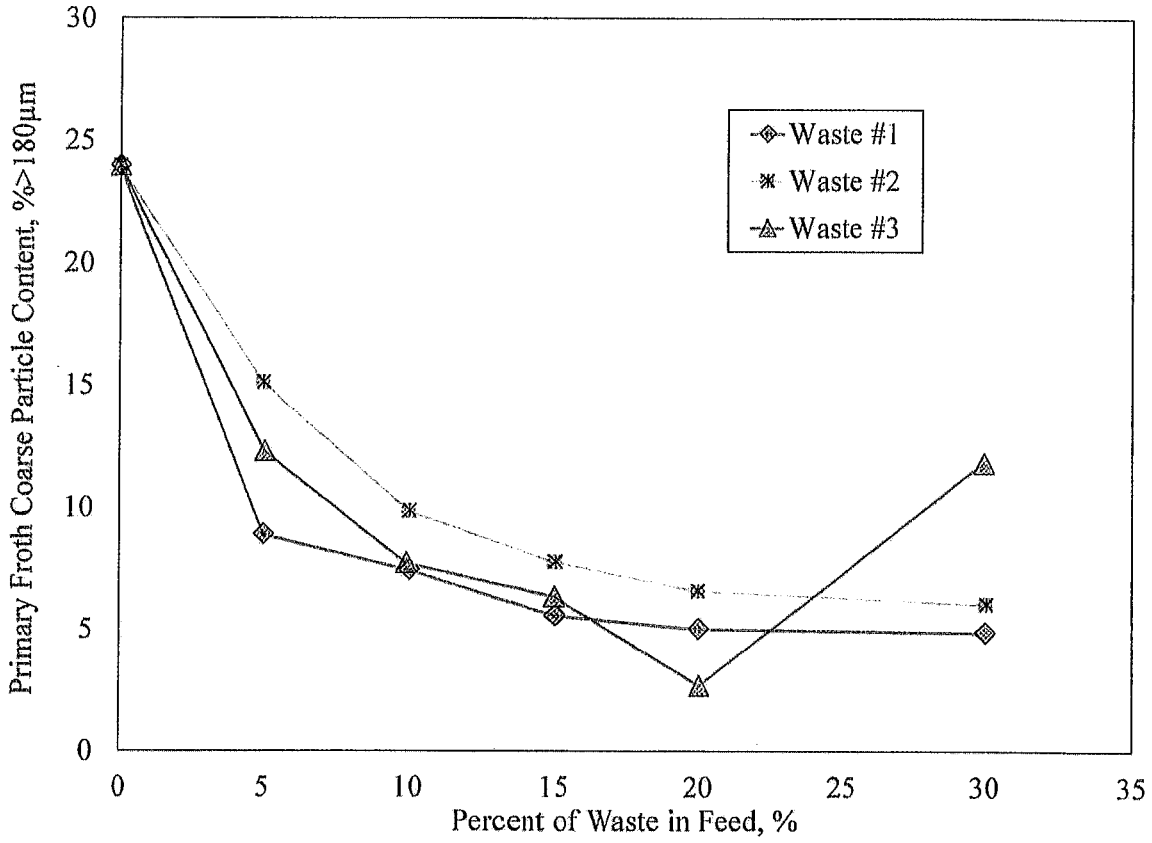
FIG. 5 is a graph showing the primary bitumen froth solids coarse particles content (>180 μm) as a function of waste dilution.

FIG. 5 is a graph of the primary froth coarse particles content (>180 μm) as a function of waste dilution with Waste #1, Waste #2 and Waste #3. FIG. 5 shows that waste dilution was able to significantly reduce the coarse particles content in the primary froth. The coarse particles content (>180 μm) in the primary froth was reduced from ~24% (no waste dilution) to 15% or lower with 5% waste addition and it was further reduced to 10% or below with 15% waste addition.

Figure 6:
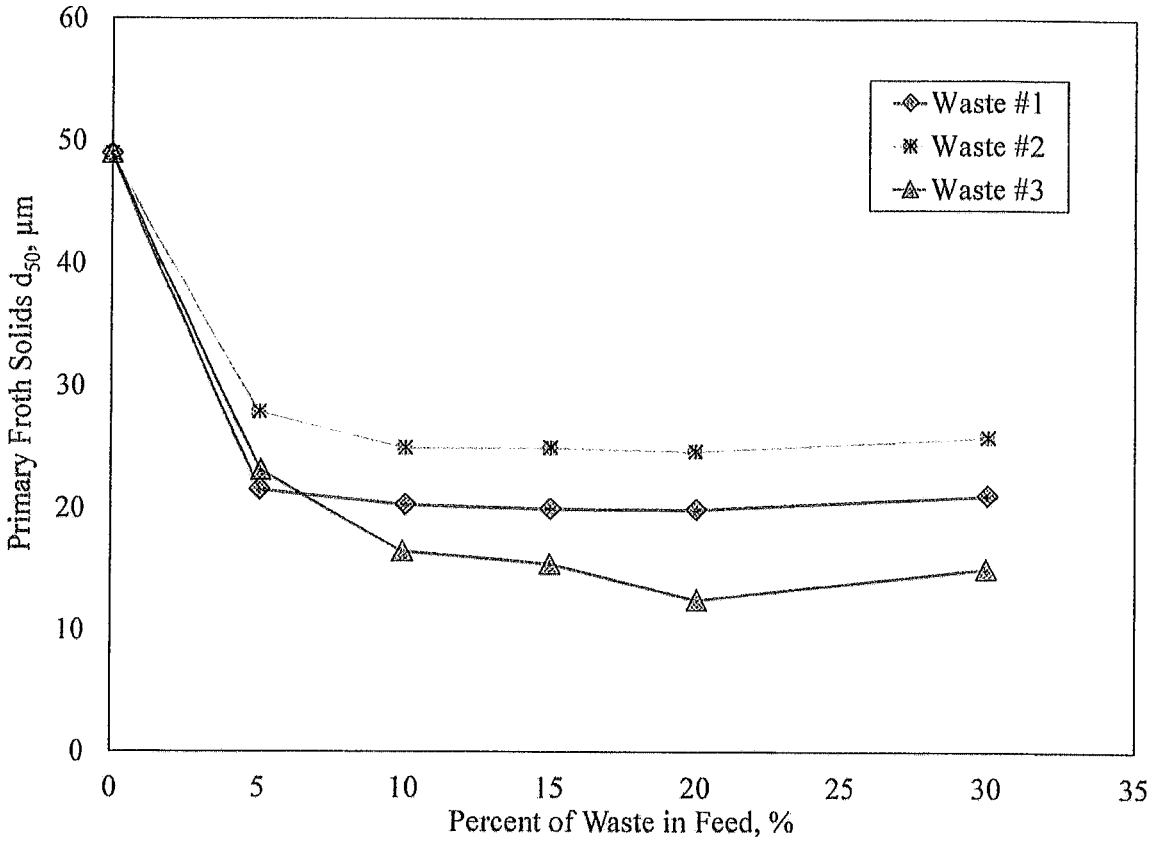
FIG. 6 is a graph showing the primary bitumen froth solids $d_{50}$ as a function of waste dilution.

FIG. 6 is a graph of the primary froth solids $d_{50}$ as a function of waste dilution with Waste #1, Waste #2 and Waste #3. Without waste dilution, the froth solids $d_{50}$ was 49 μm (coarse $d_{50}$ of 180 microns with fines content of 47 wt %). However, with waste dilution, the $d_{50}$ was reduced substantially, in particular, was reduced to below 28 μm (coarse $d_{50}$ of 135 microns with fines content of approximately 60 wt %) by adding only 5 wt % waste dilution to the ore feed.

As previously discussed, normal froth that would not cause any problems when transported in a pipeline usually has a fines content of greater than 60 wt % and coarse $d_{50}$ less than 180 microns. The expected bed height for the two ores outlined above are shown in FIG. 2 and this shows the waste diluted ore gives a significantly smaller bed height. In addition, FIG. 2 illustrates two examples from commercial plant operation, one example was prior to waste dilution being implemented (53 wt % fines and coarse $d_{50}$ of 210 microns) and the other after waste dilution was implemented (66 wt % fines and coarse $d_{50}$ of 140 microns). This indicates that waste dilution is an effective way to resolve the froth pipeline problem.

Figure 7:
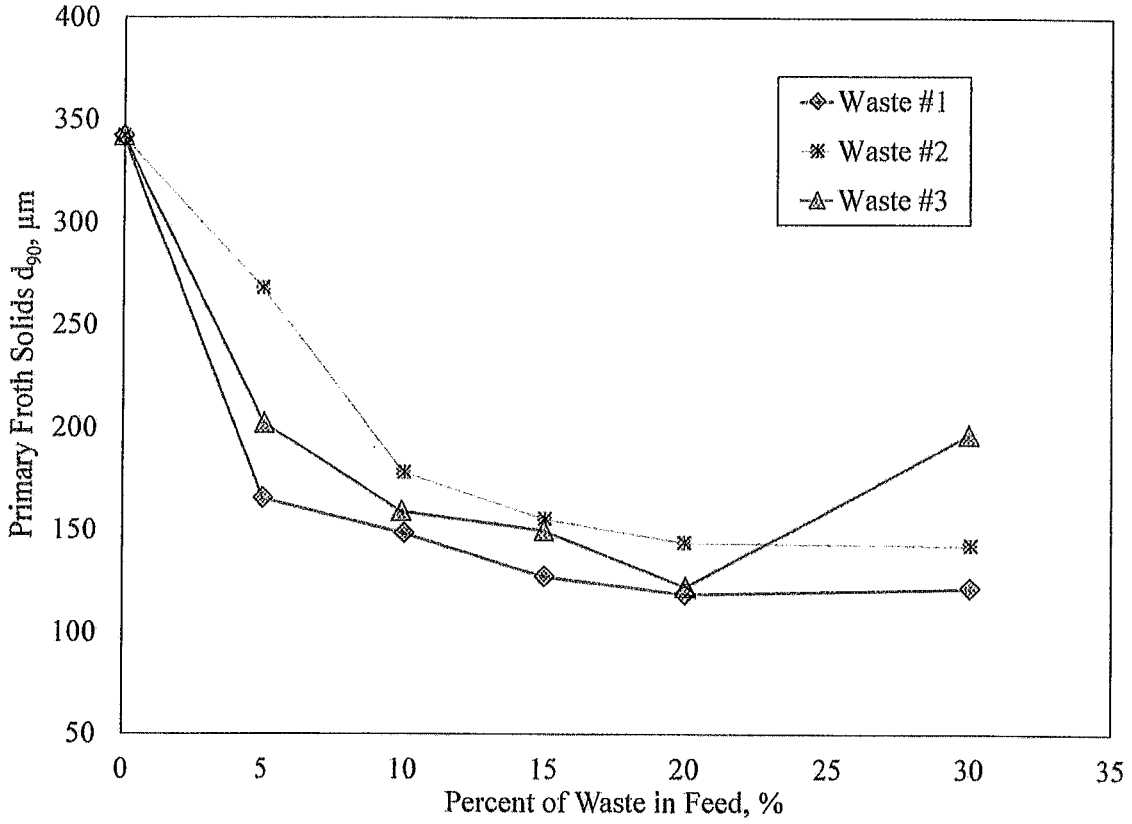
FIG. 7 is a graph showing the primary bitumen froth solids $d_{90}$ as a function of waste dilution.

FIG. 7 is a graph of the primary bitumen froth solids $d_{50}$, which shows the similar trend as shown in FIGS. 5 and 6. FIG. 7 shows that there were significant decreases in the froth solids $d_{50}$ value by waste dilution, indicating once again the effectiveness of waste dilution in improving froth transportability.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range.

Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A method for controlling the solids distribution in a bitumen froth produced when processing an oil sands ore having a $d_{50}$ of about 250 μm or greater and a $d_{90}$ of about 450 μm or greater, the method comprising the steps of:

adding a waste material having a bitumen content less than 6 wt %, a $d_{50}$ of about 50 μm or less and a fines content of about 40% of the solids or greater to the oil sands ore to form an ore blend; and processing the ore blend in a water-based bitumen extraction process to produce the bitumen froth.

2. The method as claimed in claim 1, wherein the bitumen froth has a $d_{50}$ of less than about 35 μm.

3. The method as claimed in claim 1, wherein between about 5 wt % and about 30 wt % of the waste material is added to the oil sands ore.

4. The method as claimed in claim 1, wherein the waste material has a fines content of 50% of the solids or greater.

5. The method as claimed in claim 1, wherein the waste material has a fines content of 60% of the solids or greater.

6. The method as claimed in claim 1, wherein the waste material has a fines content of 70% of the solids or greater.

7. The method as claimed in claim 1, wherein the waste material has a fines content of 80% of the solids or greater.

8. The method as claimed in claim 1, wherein the waste material is selected from the group consisting of overburden, interburden, pond mud, below cut-off grade ore and oil sand tailings.

9. The method as claimed in claim 8, wherein the oil sand tailings are Fluid Fine Tailings (FFT).

10. The method as claimed in claim 9, wherein the FFT are Mature Fine Tailings (MFT).

11. The method as claimed in claim 8, wherein the waste material is below cut-off grade ore.

* * * * *